US005606945A

United States Patent [19]

Sealock

[11] Patent Number: 5,606,945

[45] Date of Patent: Mar. 4, 1997

[54] FUEL SHUT-OFF VALVE

[76] Inventor: John W. Sealock, 1800 Belle View Blvd., Alexandria, Va. 22307

[21] Appl. No.: 363,048

[22] Filed: Dec. 23, 1994

[51] Int. Cl.[6] ..... F02B 77/00

[52] U.S. Cl. ..... 123/198 DB; 123/1 A; 137/597

[58] Field of Search ..... 123/198 DB, 510, 123/514, 198 D, 1 A; 137/597

[56] References Cited

U.S. PATENT DOCUMENTS

| | | | |
|---|---|---|---|
| 2,734,496 | 2/1956 | Hammond | 123/198 DB |
| 3,148,671 | 9/1964 | Bottorff | 123/198 DB |
| 4,188,974 | 2/1980 | Roger | 137/597 |
| 4,319,550 | 3/1982 | Stolworthy | 123/198 DB |
| 4,355,659 | 10/1982 | Kelchner | 137/597 |
| 4,369,750 | 1/1983 | Muntean | 123/198 DB |
| 4,388,909 | 6/1983 | Ogasawara et al. . | |
| 4,391,241 | 7/1983 | Dohshita | 123/198 DB |
| 4,553,504 | 11/1985 | Doggal | 123/1 A |
| 4,646,691 | 3/1987 | Kiyota | 123/1 A |
| 4,699,109 | 10/1987 | Hensel . | |
| 4,794,888 | 1/1989 | Lang . | |
| 4,794,889 | 1/1989 | Hensel . | |
| 4,856,483 | 8/1989 | Beavis et al. . | |
| 4,911,116 | 3/1990 | Prohasha | 123/1 A |
| 4,977,917 | 12/1990 | Adams | 137/597 |
| 5,090,451 | 2/1992 | Buchanan | 137/597 |
| 5,263,456 | 11/1993 | Owen-Evans . | |
| 5,495,072 | 2/1996 | Schinowsky | 137/597 |

*Primary Examiner*—Carl S. Miller
*Attorney, Agent, or Firm*—Lowe, Price, LeBlanc & Becker

[57] ABSTRACT

A fuel shut-off valve is particularly adapted for fuel systems using alcohol fuel wherein the alcohol fuel is typically pumped via an on-off valve to a fuel injection system and recirculated back to the alcohol fuel tank. The fuel shut-off valve of the invention is located between the fuel pump and the fuel injection system and is adapted to receive excess fuel from the injectors and direct it back to the fuel pump. In addition, a bypass valve arrangement directs fuel from the fuel pump to either the fuel injection system in the on or open position or back to the fuel pump when the valve is closed. The fuel shut-off valve also has a positive locking mechanism which retains the valve in the open or closed position.

14 Claims, 4 Drawing Sheets

FUEL SHUT-OFF VALVE

FIELD OF THE INVENTION

The present invention is directed to a fuel shut-off valve and, in particular, to a fuel shut-off valve particularly adapted for fuel systems utilizing alcohol.

BACKGROUND ART

In the prior art, it is well known to use alcohol fuel in modified engines for such applications as drag racing, tractor pulling or the like. Typically, these alcohol fuel systems employ an on/off valve which provides fuel from a fuel pump at maximum pressure to fuel injectors or the like.

Referring now to FIG. 1, a typical prior art alcohol fuel system is generally designated by the reference numeral 10 and includes a fuel tank 1, fuel pump 3, on/off valve 5, fuel injection system 7 and engine 9. Other conventional components such as fuel filters and fuel injection metering valves are not shown for clarity purposes.

The fuel system 10 also includes recycle or recirculating lines 11 which recirculate fuel back to the tank 1 which is not used in the engine 9. Since the on/off valve 5 is either fully open or fully closed, the amount of fuel in the recirculating lines 11 controls the fuel input to the engine 9. That is, if the fuel rate is high in recirculating lines 11, the fuel mixture to the engine will be lean. Likewise, if the recirculating fuel flow is low, the fuel mixture to the engine will be rich.

One of the problems with these types of fuel systems is fuel aeration in the fuel tank. Since the fuel is recirculated to the fuel tank, the fuel therein becomes agitated and air bubbles are entrained therein. This aerated fuel mixture, necessarily having a lower BTU or fuel value, is then fed to the fuel injection system. The lower fuel value results in poorer engine performance.

Recirculating the fuel back to the fuel tank is also costly since long runs of the recirculating fuel lines are needed. The lines being made of braided stainless steel surrounding a high pressure rubber hose. Moreover, since modern fuel injection systems use three or four fuel injectors, each injector having its own recirculating line 11, a large quantity of hose is required for recirculation.

The prior art fuel system is also disadvantageous in that the on/off valve can slip out of the fully on position and starve the fuel injection system and engine of necessary fuel.

In view of the disadvantages noted above, a need has developed for an improved alcohol-based fuel system. In response to this need, the present invention provides a unique fuel shut-off valve which eliminates the need for extensive lengths of recirculating hose line, aerated fuel and improperly functioning on/off valves. The present invention provides a fuel shut-off valve which recirculates unused fuel from both the fuel pump and fuel injection system directly to the fuel pump rather than the fuel tank. The inventive valve also includes a positive locking mechanism to maintain the valve in its on or off position.

SUMMARY OF THE INVENTION

Accordingly, it is a first object of the present invention to provide a new and improved fuel shut-off valve, particularly adapted for fuel systems using alcohol.

Another object of the present invention is to provide a fuel shut-off valve which positively locks in the on or off position.

A further object of the present invention is to provide a fuel shut-off valve and system which eliminates costly recirculating lines and fuel aeration.

Other objects and advantages of the present invention will become apparent as a description thereof proceeds.

In satisfaction of the foregoing objects and advantages, the present invention is an improvement in alcohol fuel systems using a manual fuel pump which supplies fuel to a fuel injection system and which also recycles the fuel from the fuel injection system back to a fuel tank. According to the invention, a fuel shut-off valve is provided and located between the fuel pump and the fuel injection system. The fuel shut-off valve includes at least one inlet to receive excess fuel from the fuel injectors and means to direct it back to the fuel pump. A bypass valve arrangement is also provided which directs fuel from the fuel pump to either the fuel injection system or back to the fuel pump.

In another aspect of the invention, the fuel shut-off valve has a positive locking mechanism which locks the valve in an open position which connects the fuel pump and fuel injection system or a closed position which then recirculates the fuel received from the fuel pump back thereto.

In a more preferred embodiment, the fuel shut-off valve comprises a valve body having a first inlet and a first outlet, the first inlet and outlet in communication via a valve chamber. The valve body also includes at least one second inlet, preferably three or four second inlets, and an outlet passageway. The second inlet is in communication with the outlet passageway. The outlet passageway also provides communication between the valve chamber and a second outlet for recirculation of fuel back to the fuel pump.

Surplus fuel from the fuel injectors flows into one or more of the second inlets and is recirculated back to the fuel pump via the outlet passageway and second outlet.

A valve is provided in the valve chamber, the valve configured to provide communication between the first inlet and outlet, i.e., the on position, or between the first inlet and the outlet passageway, i.e., the off position wherein fuel is recirculated back to the fuel pump.

BRIEF DESCRIPTION OF THE DRAWINGS

Reference is now made to the drawings wherein:

FIG. 5 is a side view of the valve body of

FIGS. 3*a*–3*c* with installed covers;

FIG. 7 is a side view along the line VII—VII of

FIG. 6; and

DESCRIPTION OF THE PREFERRED EMBODIMENTS

Figure 1:
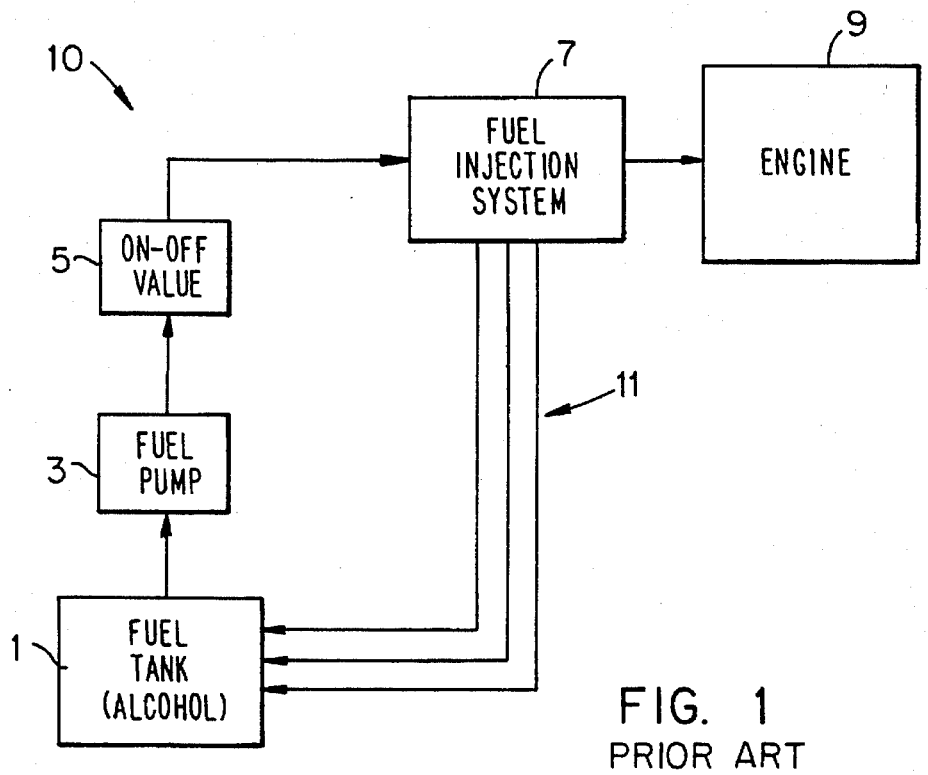
FIG. 1 PRIOR ART
FIG. 1 is a flow diagram of an alcohol fuel system according to the prior art.
Figure 2:
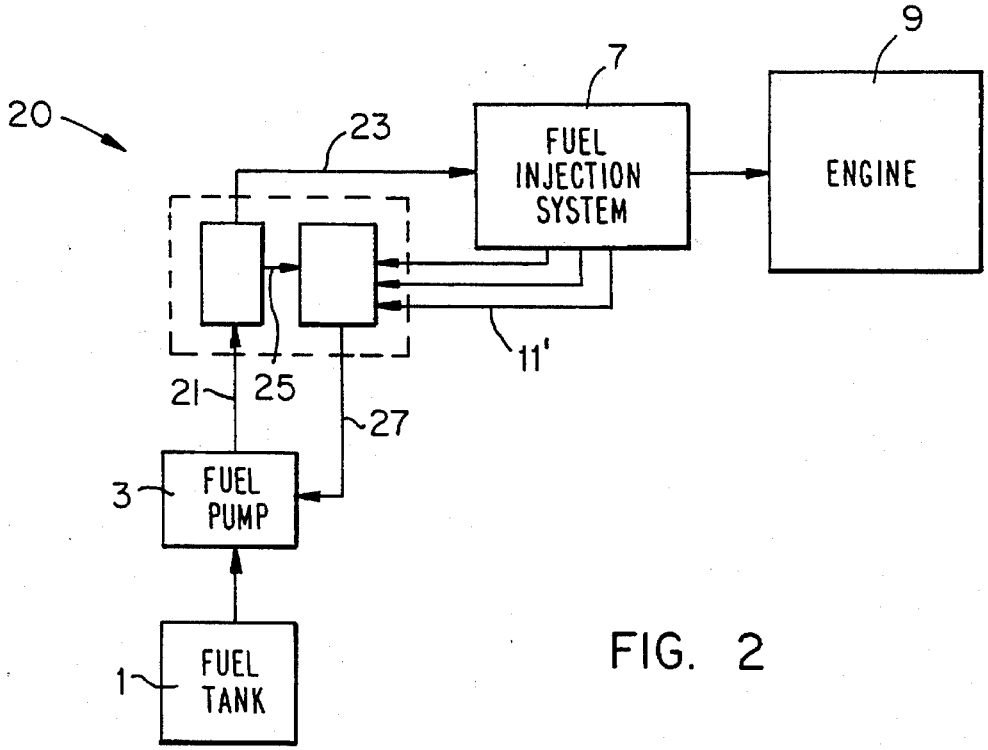
FIG. 2 is a flow diagram of an alcohol fuel system according to the invention.

With reference now to FIG. 2, the inventive fuel shut-off valve is generally designated by the reference numeral 20.

The fuel shut-off valve 20 is combined with an alcohol fuel system comprising the fuel tank 1, fuel pump 3, fuel injection system 7 and engine 9. According to the invention, the fuel shut-off valve 20 receives fuel 21 in an inlet thereof from the pump 3 and directs the fuel via line 23 to the fuel injection system when the valve is in the open position.

When the valve is closed, the fuel 21 flows via line 25 and combines with the recirculated fuel in the recirculation fuel lines 11'. This fuel is then recirculated to the fuel pump 3 via the recirculation line 27.

In this arrangement, long lengths of expensive hose are eliminated since the recirculating lines 11' are only required to go to the fuel shut-off valve 20 rather than the fuel tank 1. Moreover, eliminating the recirculation to the fuel tank avoids aeration of the fuel therein. Furthermore, the fuel shut-off valve also avoids unnecessary line pressurization by recirculating fuel to the fuel pump when the valve is in the off position. In prior art systems, shutting the valve off results in high pressure upstream of the valve since the fuel pump is still operating without recirculation.

It is should be understood that the inventive fuel shut-off valve 20 can be constructed in any fashion as long as the various fuel flows as represented by references numerals 21, 23, 25 and 27 are achieved. For example, the fuel shut-off valve can be made from a single unit having the necessary inlets, outlets and passageways to both supply fuel to the fuel injection system as well as recirculate fuel back to the fuel pump. Alternatively, more than one valve body or unit can be utilized to achieve the same purpose.

Figure 3A:
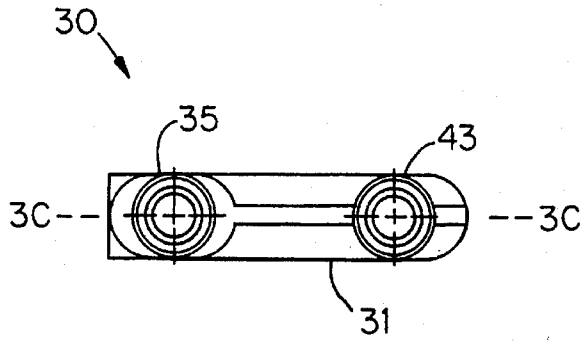
FIGS. 3*a*–3*c* are a bottom view, left side view and a cross-sectional view, respectively, of a preferred embodiment of the inventive fuel shut-off valve.
Figure 3B:
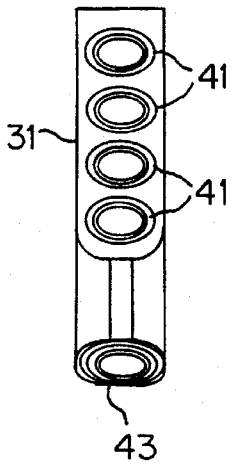
Figure 3C:
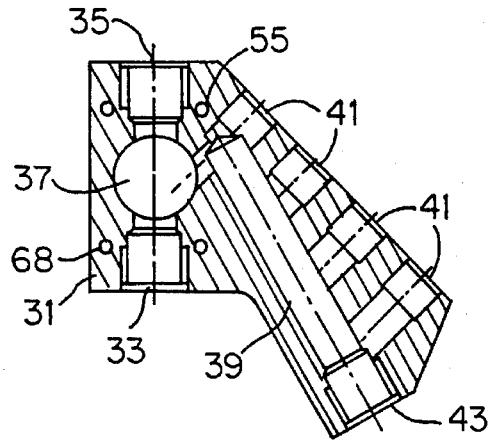

With reference now to FIGS. 3*a*–3*c* a preferred embodiment of the inventive fuel shut-off valve is generally designated by the reference numeral 30 and is seen to include a valve body 31 having a fuel pump inlet 33 and an outlet 35 to a fuel injection system. A valve chamber 37 is disposed between the inlets 33 and 35 providing communication therebetween. The valve chamber 37 also communicates with an outlet passage 39 via bore 55. The outlet passage also communicates with a plurality of inlets 41 which receive excess fuel from the fuel injection system. Fuel from passing into the inlets 41 is combined in the outlet passage 39 and recirculated to the fuel pump via outlet 43.

Figure 4A:
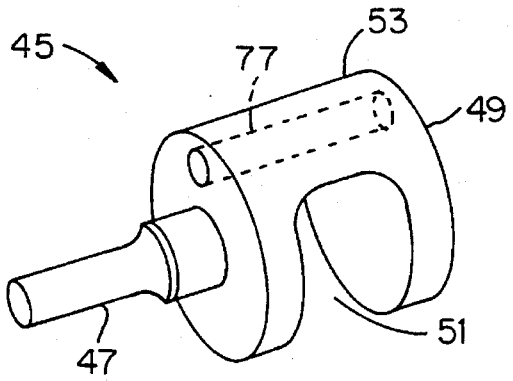
FIGS. 4*a* and 4*b* are perspective and side views of the valve spool of the fuel shut-off valve.
Figure 4B:
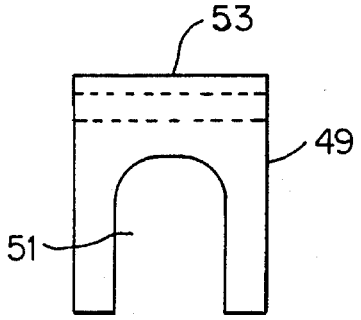

With reference now to FIGS. 4*a* and 4*b*, a valve spool generally designated by the reference numeral 45 is depicted. The valve spool 45 includes a stem 47 which facilitates rotation thereof, the stem 47 extending outwardly from the spool body 49.

The spool body 49 is sized to fit in the cylindrical valve chamber 37 for rotation therein.

In the on position, the valve spool 45 is rotated such that the valve passageway 51 provides communication between the inlet 33 and the outlet 35. In this mode, the valve spool body face 53 blocks the bore 55 arranged between the valve chamber 37 and outlet passageway 39, see FIG. 3*c*.

In the off or recirculating position, the valve spool 45 is rotated such that the spool face 53 blocks the outlet 35. In this mode, the fuel entering the inlet 33 from the fuel pump passes through the valve passageway 51 into the outlet passageway 39 via the bore 55. The fuel is continuously recycled to the fuel pump, thereby avoiding unnecessary pressure build up when the valve is in the closed or off position.

The positive locking mechanism of the invention will now be described. With reference to FIGS. 5–8, the valve body 31 is shown with installed covers 61 and 63. The covers are secured by nut, washer and bolt assemblies 65 extending through bores 67 in the covers and bores 68 in the valve body, see FIG. 3*c*.

The cover 61 includes a bore therethrough for receipt of the valve spool stem 47. The O ring 73 is arranged in the step 74 formed between the bore 62 and the detent-containing surface 76.

Each of the covers includes an annular recess 69 which receives an O-ring 71 or other sealing means for valve chamber sealing purposes.

The valve spool stem 47 also has a sealing ring such as an 0-ring 73 therearound for sealing purposes.

Figure 5:
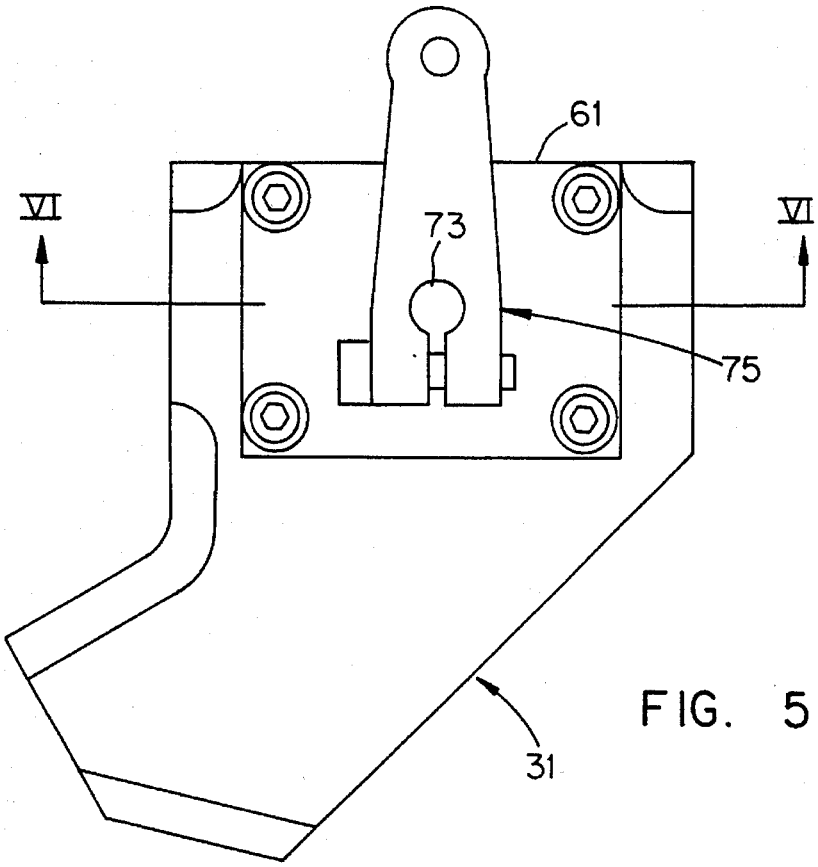
Figure 6:
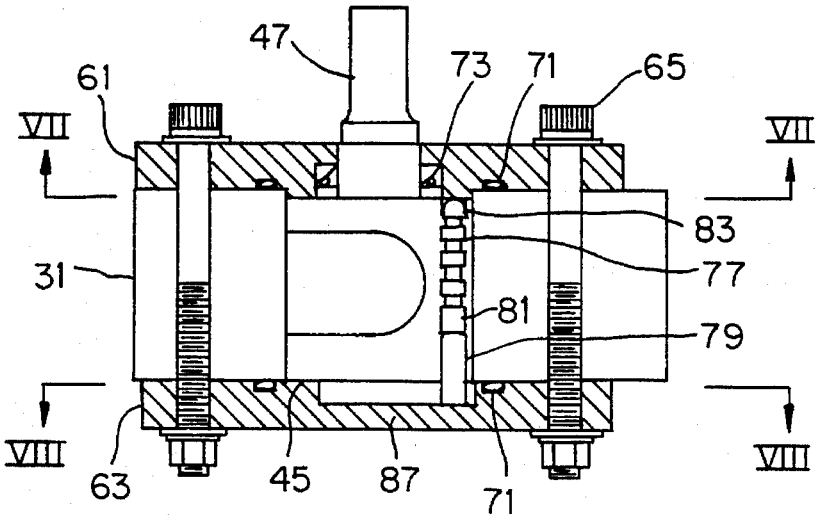
FIG. 6 is a cross-sectional view along the line VI—VI of FIG. 5.

With reference to FIG. 5, the valve spool end 73 includes a lever assembly 75 for valve spool rotation. In FIGS. 5 and 6, the valve spool is shown in the on position so that fuel flows to the fuel injection system.

Figure 7:
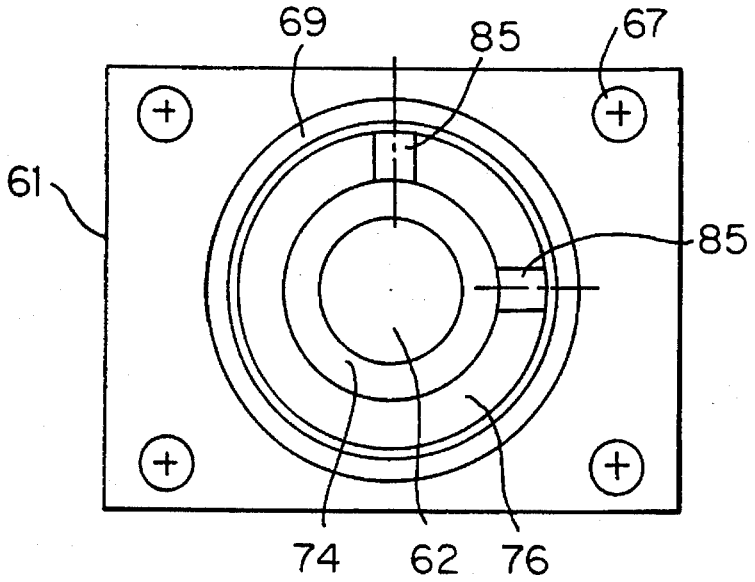
Figure 8:
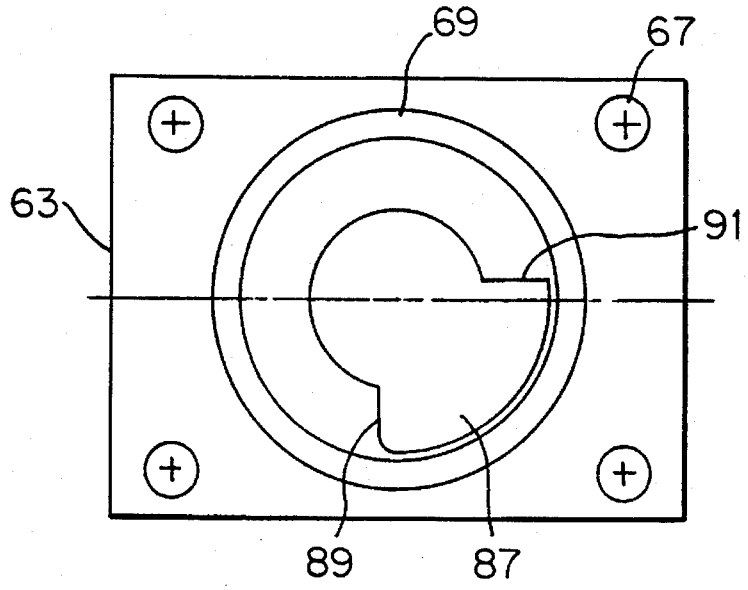
FIG. 8 is a side view along the line VIII—VIII of FIG. 6.

With reference now to FIGS. 6–8, the valve spool has a bore 77 therethrough. Within the bore is a pin 79, spring 81 and ball 83. The ball is biased by the spring 81 toward the cover 61.

In connection with the spring loaded ball 83, the cover 61 has a pair of detents 85 formed therein. The detents 85 receive the ball 83 to lock the valve spool 45 in either the open or closed position. In connection with the detents 85 and the cover 61, a recess 87 is formed with stops 89 and 91 in cover 63. The recess 87 accommodates travel of the pin 79 during valve spool rotation. In the open position, the pin 79 engages stop 89. In a closed position, the pin 79 travels within the recess 87 to engage stop 91. The recess 87 controls movement of the pin 79 and rotation of the valve spool between the open and closed position. The detents 85 and spring-loaded ball 83 positively lock the valve spool in either the completely open or completely closed position. Thus, the valve spool cannot move when open to reduce the flow of fuel to the injection system.

As such, an invention has been disclosed in terms of preferred embodiments thereof which fulfill each and everyone of the objects of the present invention as set forth hereinabove and provides a new and improved fuel shut-off valve.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A fuel shut-off valve comprising:

a) a valve body having:

i) a first inlet and a first outlet, said first inlet and said first outlet in communication via a valve chamber;

ii) a plurality second inlets;

iii) an outlet passageway, said plurality of second inlet in communication with said outlet passageway, said outlet passageway providing communication between said valve chamber and a second outlet and between said at least one plurality of second inlet and said second outlet; and b) a valve arranged in said valve chamber and configured to provide communication between either said first inlet and said first outlet or said first inlet and said outlet passageway.

2. The fuel shut-off valve of claim 1 wherein said valve has a locking mechanism to positively lock said valve in a first position communicating said first inlet with said first outlet and a second position communicating said first inlet with said outlet passageway.

3. The fuel shut-off valve of claim 2 wherein said positive locking mechanism further comprises a spring arranged in said valve for engagement with first and second detents corresponding to said first and second positions.

4. The fuel shut-off valve of claim 3 further comprising front and back covers for said valve body, one of said covers including said first and second detents.

5. The fuel shut-off valve of claim 4 wherein said spring loaded ball includes a pin which travels between stops in a recess in the other cover to control rotation of said valve.

6. In an alcohol fuel system using a manual fuel pump which supplies fuel to a fuel injection system and which recycles said fuel from said fuel injection system back to a fuel tank, the improvement comprising a fuel shut-off valve located between said manual fuel pump and said fuel injection system, said fuel shut-off valve including at least one inlet to receive excess fuel from said fuel injectors and direct it back to said fuel pump and a bypass valve arrangement which either directs fuel from said fuel pump to said fuel injection system or recirculates fuel from said fuel pump back to said fuel pump.

7. The alcohol fuel system of claim 6 wherein said fuel shut-off valve further comprises:

a) a valve body having:

i) a first inlet and a first outlet, said first inlet and outlet in communication via a valve chamber;

ii) at least one second inlet;

iii) an outlet passageway, said at least one second inlet in communication with said outlet passageway, said outlet passageway providing communication between said valve chamber and a second outlet and between said at least one second inlet and said second outlet b) a valve arranged in said valve chamber and configured to provide communication between either said first inlet and said first outlet or said first inlet and said outlet passageway;

c) wherein said fuel pump supplies fuel to said first inlet, said first outlet provides fuel to said fuel injection system, said at least one second inlet receives fuel from said fuel injection system and said second outlet recirculates fuel to said fuel pump from said first inlet and said at least one second inlet.

8. The fuel shut-off valve of claim 7 further comprising a plurality of second inlets.

9. The fuel shut-off valve of claim 7 wherein said valve has a locking mechanism to positively lock said valve in a first position communicating said first inlet with said first outlet and a second position communicating said first inlet with said outlet passageway.

10. The fuel shut-off valve of claim 9 wherein said positive locking mechanism further comprises a spring loaded ball arranged in said valve for engagement with first and second detents corresponding to said first and second positions.

11. The fuel shut-off valve of claim 10 further comprising front and back covers for said valve body, one of said covers including said first and second detents.

12. The fuel shut-off valve of claim 4 wherein said spring loaded ball include a pin which travels between stops in a recess in the other cover to control rotation of said valve.

13. The fuel shut-off valve of claim 1 wherein said plurality of second inlets comprises one of three inlets and four inlets.

14. The fuel shut-off valve of claim 8 wherein said plurality of second inlets comprises one of three inlets and four inlets.

* * * * *